US012690652B2

(12) United States Patent
Feng

(10) Patent No.: US 12,690,652 B2
(45) Date of Patent: Jul. 28, 2026

(54) SUITCASE TELESCOPIC HANDLE AND SUITCASE

(71) Applicant: Jiaxing Packdrop Luggage Technology Co., Ltd., Jiaxing (CN)

(72) Inventor: Tan Feng, Jiaxing (CN)

(73) Assignee: Jiaxing Packdrop Luggage Technology Co., Ltd., Jiaxing (CN)

( * ) Notice: Subject to any disclaimer, the term of this patent is extended or adjusted under 35 U.S.C. 154(b) by 0 days.

(21) Appl. No.: 19/236,150

(22) Filed: Jun. 12, 2025

(65) Prior Publication Data

US 2026/0144347 A1 May 28, 2026

(30) Foreign Application Priority Data

Nov. 28, 2024 (CN) ..... 202422926104.7

(51) Int. Cl.
*A45C 13/26* (2006.01)
*A45C 5/04* (2006.01)

(52) U.S. Cl.
CPC ..... *A45C 13/262* (2013.01); *A45C 5/04* (2013.01); *A45C 2013/267* (2013.01)

(58) Field of Classification Search
CPC ..... A45C 13/262; A45C 2013/267
USPC ..... 190/115; 16/113.1
See application file for complete search history.

(56) References Cited

U.S. PATENT DOCUMENTS 5,706,921 A * 1/1998 Wang ..... A45C 13/262 190/115
10,016,034 B2 * 7/2018 Lee ..... A45C 13/28
2002/0043544 A1 * 4/2002 Caneba ..... F16B 7/0493 224/584
2005/0279600 A1 * 12/2005 Goldwitz ..... A45C 13/262 16/113.1
2012/0006638 A1 * 1/2012 Semersky ..... A45C 13/28 223/89
2013/0264160 A1 * 10/2013 Mediamolle ..... A45C 13/28 190/102
2013/0313058 A1 * 11/2013 Yoshida ..... A45C 5/14 16/113.1
2025/0176685 A1 * 6/2025 McKelvey ..... A45C 5/14

* cited by examiner

*Primary Examiner* — Sue A Weaver
(74) *Attorney, Agent, or Firm* — Hemisphere Law, PLLC

(57) ABSTRACT

A suitcase telescopic handle and a suitcase belonging to the field of suitcase technologies are provided. The suitcase telescopic handle includes a telescopic rod, a handlebar and a movable hanging rod. The telescopic rod is provided two in number being respectively connected to two ends of the handlebar, and the telescopic rod is configured to installed on a main body of a suitcase. The movable hanging rod is disposed on the handlebar, the movable hanging rod and the handlebar are operative to form a closed frame structure for hanging items. Alternatively, the movable hanging rod is disposed on the telescopic rod, or disposed on both the handlebar and the telescopic rod. The movable hanging rod is rotatable to define a gap to open the closed frame structure, which facilitates a user to hang items on the movable hanging rod.

6 Claims, 12 Drawing Sheets

SUITCASE TELESCOPIC HANDLE AND SUITCASE

TECHNICAL FIELD

The disclosure relates to the field of suitcase technologies, and more particularly to a suitcase telescopic handle and a suitcase.

BACKGROUND

A suitcase is a kind of commonly used tool for traveling, allowing a user to place carry-on items inside the suitcase for carrying and transporting.

However, with an existing suitcase, once a main body of the suitcase is fully packed with luggage, items like an umbrella, drinks and snacks that the user needs to use temporarily during the travelling, or various large bags and small bags purchased during the travelling, that placed on a top surface of the suitcase tend to slide off or fall. The user has to hold these items in one hand while pulling the suitcase with the other hand, so that when handling various travelling-related tasks such as answering phone calls, passing through ticket checks, or undergoing security inspections, the lack of free hands often leaves the user flustered and significantly inconvenient.

SUMMARY

A purpose of the disclosure is to provide a suitcase telescopic handle and a suitcase, so as to solve the technical problems that for the existing suitcase, once the main body of the suitcase is fully packed with luggage, items like a umbrella, drinks and snacks that the user needs to use temporarily during the travelling, or various large bags and small bags purchased during the travelling, that placed on the top surface of the suitcase tend to slide off or fall. The user has to hold these items in one hand while pulling the suitcase with the other hand, so that when handling various travelling-related tasks such as answering phone calls, passing through ticket checks, or undergoing security inspections, the lack of free hands often leaves the user flustered and significantly inconvenient.

In a first aspect, a suitcase telescopic handle according to an embodiment of the disclosure includes a telescopic rod, a handlebar, and a movable hanging rod;

- the telescopic rod is two in number being respectively connected to two ends of the handlebar, and the telescopic rod is configured (i.e., structured and arranged) to be installed on a main body of a suitcase;
- the movable hanging rod is disposed on the handlebar, and the movable hanging rod and the handlebar are operative to form a closed frame structure for hanging items; or the movable hanging rod is disposed on the telescopic rod, and the movable hanging rod, the telescopic rod and the handlebar are operative to form a closed frame structure for hanging items; or the movable hanging rod is disposed on the handlebar and the telescopic rod, and the movable hanging rod, the telescopic rod and the handlebar are operative to form a closed frame structure for hanging items; and
- the movable hanging rod is rotatable to define a gap to open the closed frame structure.

In an embodiment, the movable hanging rod includes a first rod body and a second rod body. Moreover, a first end of the first rod body is connected to the handlebar or the telescopic rod, a first end of the second rod body is connected to the handlebar or the telescopic rod, a second end of the first rod body corresponds to a second end of the second rod body, the first rod body is rotatable, and the first rod body can be rotated to define the gap between the first rod body and the second rod body.

In an embodiment, the first rod body is bent in shape, and includes a first section and a second section, the first section is connected to a gripping part of the handlebar, the second section is rotatable relative to the first section. Moreover, the second rod body is bent in shape, and the first of the second rod body is connected to the gripping part of the handlebar; or the second rod is straight in shape, and the first end of the second rod body is connected to a connecting part of the handlebar or the telescopic rod. In addition, the second end of the second rod body corresponds to the second section.

In an embodiment, the movable hanging rod includes a first rod body and a third rod body. Moreover, an end of the third rod body is connected to a connecting part of the handlebar or one the telescopic rod, another end of the third rod body is connected to another connecting part of the handlebar or another the telescopic rods. In addition, the first rod body is disposed between a gripping part of the handlebar and the third rod body, and an end of the first rod body is rotatably connected to the third rod body, and the first rod body is operative to define the gap between the gripping part of the handlebar and the first rod body by rotation.

In an embodiment, the movable hanging rod further includes a second rod body, the second rod body is disposed between the gripping part of the handlebar and the third rod body, and an end of the second rod body is connected to the gripping part of the handlebar, another end of the second rod body corresponds to the first rod body, the first rod body is operative to define the gap between the second rod body and the first rod body by rotation.

In an embodiment, a limiting structure is provided between the first rod body and the second rod body, the limiting structure is configured to limit the rotation direction of the first rod body and thereby, allow the first rod body unidirectionally rotate.

In an embodiment, the limiting structure includes a limiting protrusion and a limiting groove matched with each other (so that the limiting protrusion and the limiting groove are engageable with each other), the limiting protrusion is disposed on one of the first rod body and the second rod body, and the limiting groove is disposed on the other one of the first rod body and the second rod body.

In an embodiment, the suitcase telescopic handle further includes a torsion spring, and the torsion spring is disposed at a rotation part of the movable hanging rod.

In an embodiment, the suitcase telescopic handle further includes a handle base configured to be disposed on the main body of the suitcase, the telescopic rod is disposed on the handle base, and the movable hanging rod is spaced from the handle base.

In a second aspect, a suitcase according to an embodiment of the disclosure includes the suitcase telescopic handle according to any one of the above-mentioned embodiments.

Compared with the related art, the suitcase telescopic handle and the suitcase according to the disclosure may have technical advantages as follows.

The disclosure provides a suitcase telescopic handle, which includes a telescopic rod, a handlebar and a movable hanging rod. The telescopic rod is two in number being respectively connected to two ends of the handlebar, and the telescopic rod is configured to be installed on a main body of a suitcase. Moreover, the movable hanging rod is disposed on the handlebar, and the movable hanging rod and the handlebar are operative to form a closed frame structure for hanging items; or, the movable hanging rod is disposed on the telescopic rod, and the movable hanging rod, the telescopic rod and the handlebar are operative to form a frame structure for hanging the items; or, the movable hanging rod is disposed on the handlebar and the telescopic rod, and the movable hanging rod, the telescopic rod and the handlebar are operative to form a closed frame structure for hanging the items. In addition, the movable hanging rod is rotatable (e.g., a part of the movable hanging rod can be rotated) to define a gap to open the closed frame structure.

When in use, the closed frame structure can be opened by conducting a rotation operation onto the movable hanging rod, allowing a user to conveniently hang multiple items such as small handbags, an umbrella, bags containing snacks and water bottles on the movable hanging rod at any time. Therefore, hands of the user can be freed up for other travel-related tasks like answering calls, passing ticket checks or shopping to avoid being flustered and disorganized and thus effortless and hassle-free for the user. In addition, when undergoing a security check, the suitcase telescopic handle can be retracted, allowing the suitcase and all the attached/hung items to be placed on a security conveyor belt together, which can prevent these items from scattering and getting lost, and can also avoid congestion caused by excessively long waits for passengers further back in the security queue. The movable hanging rod is disposed on the handlebar and/or the telescopic rod, it does not occupy a storage/accommodating space of the main body of the suitcase and also does not increase a volume of the main body of the suitcase, and moreover does not affect an appearance of the main body, as well as storing, boarding or checking-in of the suitcase. When the suitcase telescopic handle is extended, the movable hanging rod rises up correspondingly and its height can be closer to an upper body of the user, enabling the user to easily access the items without bending down while pushing the suitcase or standing in line, offering a highly user-friendly experience.

The suitcase provided by the disclosure includes the above-mentioned suitcase telescopic handle. Therefore, the suitcase achieves the same technical advantages and effects as that of the suitcase telescopic handle, and thus will not be repeated herein.

Additional features and advantages of the disclosure will be elaborated in detail in a subsequent detailed description of embodiments.

BRIEF DESCRIPTION OF DRAWINGS

In order to more clearly describe illustrative embodiments of the disclosure or the technical solutions in the related art, a brief introduction to the attached drawings used in the description of the illustrative embodiments or the related art will be given below. Apparently, the attached drawings described below are some embodiments of the disclosure. For those skilled in the art, other drawings can also be obtained based on these attached drawings without making creative efforts.

Figure 1:
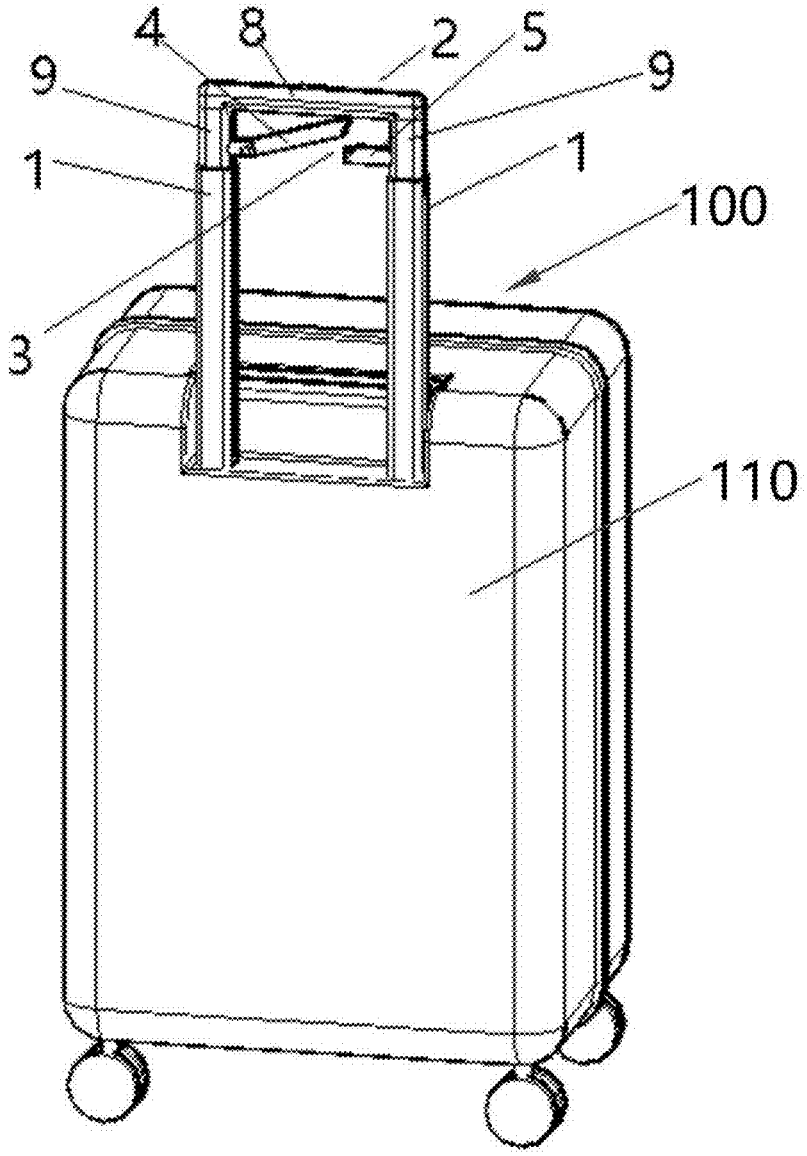
FIG. 1 illustrates a schematic structural view of a movable hanging rod of the disclosure.

Description of numerical references:

1—telescopic rod; 2—handlebar; 3—gap; 4—first rod body; 5—second rod body; 6—first section; 7—second section; 8—gripping part; 9—connecting part; 10—first inclined surface; 11—second inclined surface; 12—limiting protrusion; 13—limiting groove; 14—third rod body; 15—handle base; 16—torsion spring; 21—movable hanging rod; 22—closed frame structure; 100—suitcase, 110—main body.

DETAILED DESCRIPTION OF EMBODIMENTS

In the following description, technical solutions of the disclosure will be described clearly and completely in conjunction with embodiments of the disclosure. Apparently, the described embodiments are some embodiments of the disclosure, rather than all of embodiments of the disclosure. Based on the described embodiments of the disclosure, all other embodiments obtained by those skilled in the art without creative work are within the scope of protection of the disclosure.

In the following description of the described embodiments of the disclosure, it should be noted that terms such as "center", "upper", "lower", "left", "right", "vertical", "horizontal", "inner", "outer", etc., indicate orientations or positional relationships based on orientations or positional relationships shown in the attached drawings, and the terms are used merely for the convenience of describing the disclosure and simplifying the description, rather than to indicate or imply that devices or elements referred to must have specific orientations, be constructed or operated in specific orientations, and therefore should not be construed as limiting the disclosure. Furthermore, terms "first", "second", and "third" are used merely for descriptive purposes and should not be understood as indicating or implying relative importance.

In the description of the described embodiments of the disclosure, it should be noted that, unless otherwise expressly stated and defined, terms "install", "connected with" and "connected to" should be broadly understood. For example, it can refer to a fixed connection, a detachable connection, or an integral connection; it can be a mechanical connection or an electrical connection; it can be a direct connection, an indirect connection through an intermediate medium, or an internal connection/communication between two components. For those skilled in the art, the specific meanings of the above terms in the embodiments of the disclosure can be understood in the context of specific circumstances.

In addition, the technical solutions of the respective embodiments can be combined with one another, provided that such combination can be implemented by those skilled in the art. If the combination of technical solutions leads to contradictions or is unachievable, it should be deemed as such a combination of technical solutions does not exist and is excluded from the scope of protection of the disclosure.

The following is a detailed description of the disclosure with reference to the attached drawings and specific embodiments.

Figure 2:
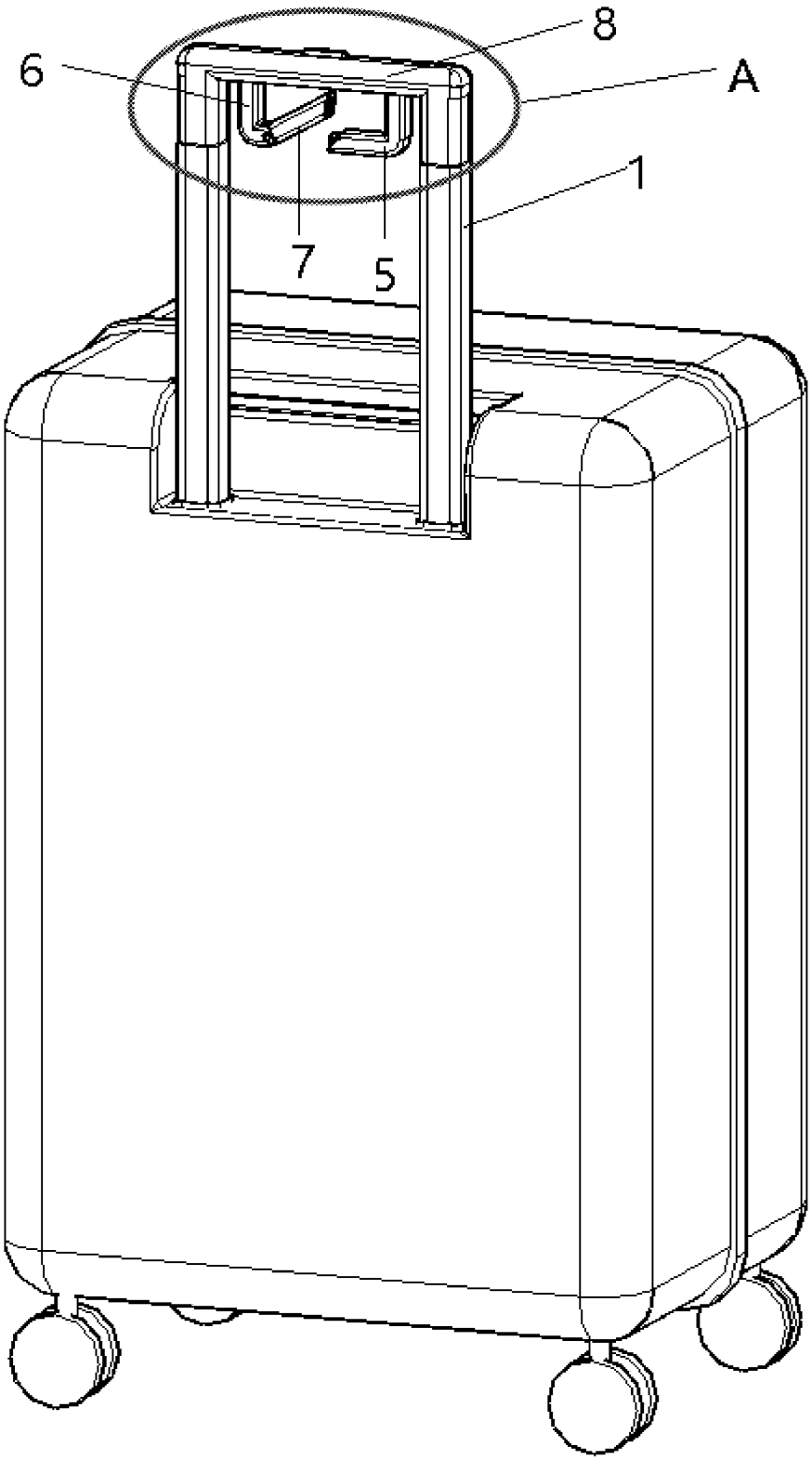
FIG. 2 illustrates a schematic structural view of another movable hanging rod of the disclosure.
Figure 3:
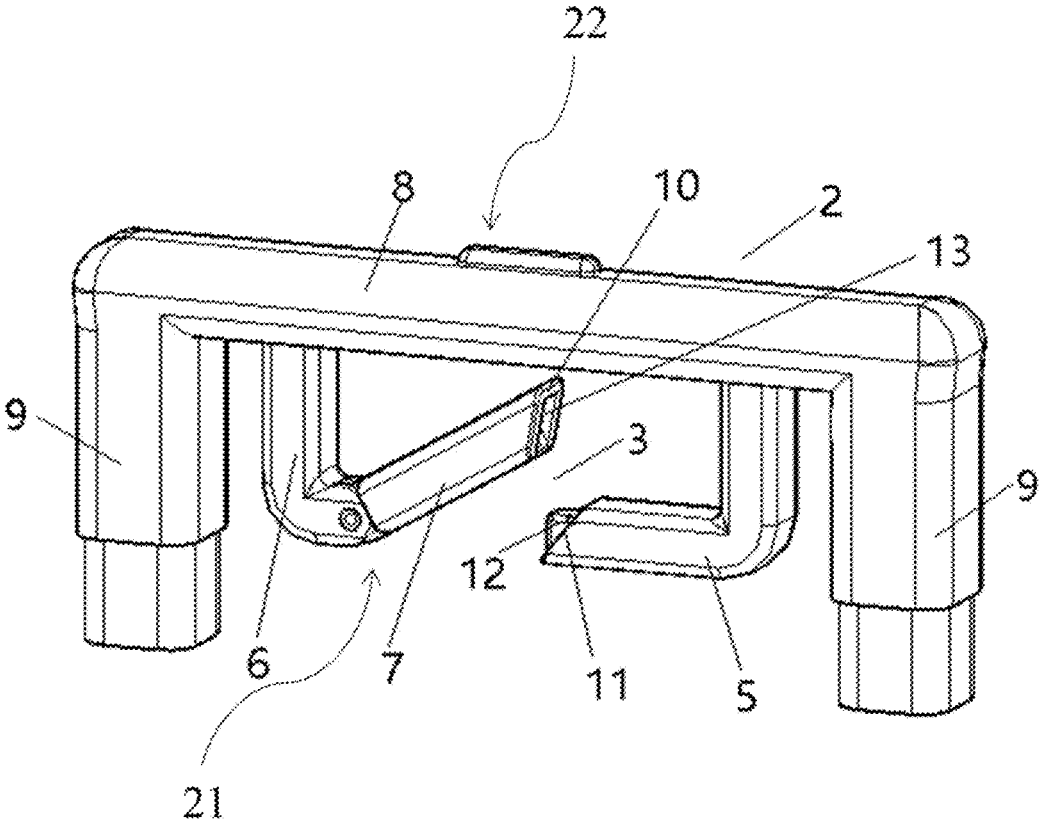
FIG. 3 illustrates a schematic partial enlarged view of the portion A in FIG. 2.
Figure 4:
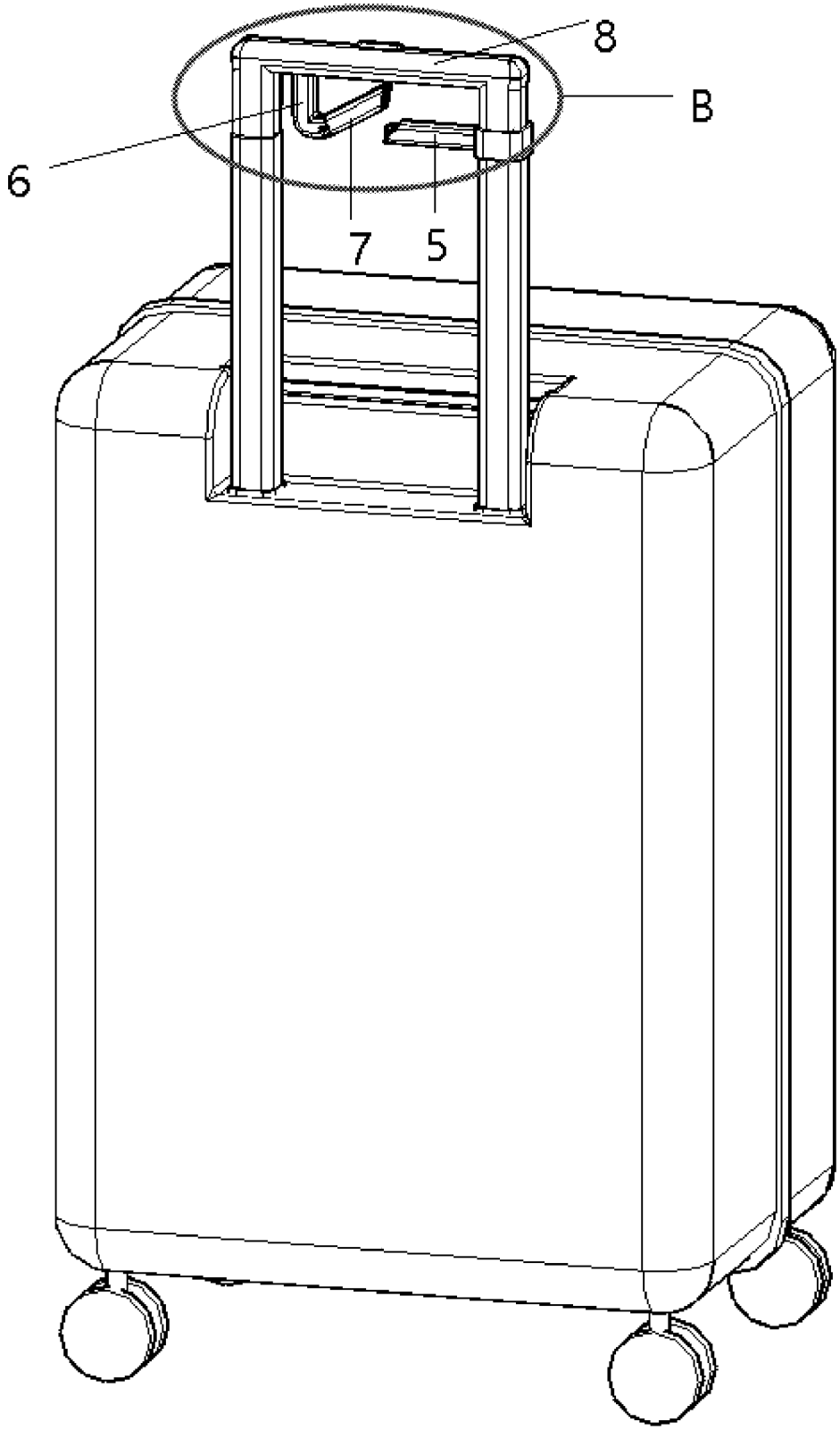
FIG. 4 illustrates a schematic structural view of still another movable hanging rod of the disclosure.
Figure 5:
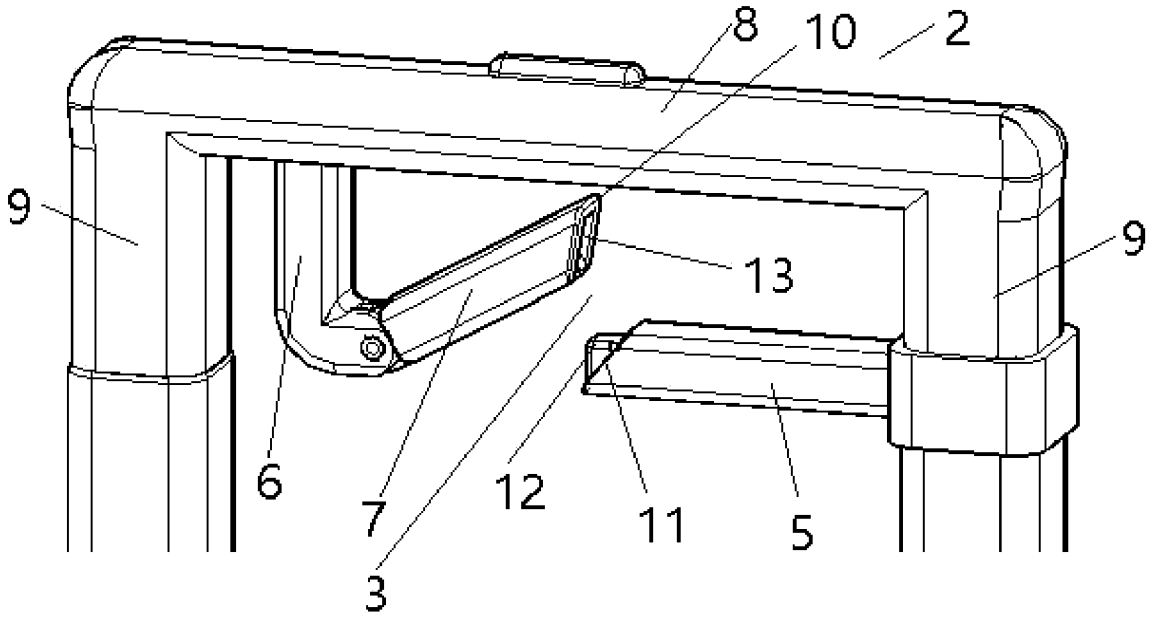
FIG. 5 illustrates a schematic partial enlarged view of the portion B in FIG. 4.
Figure 6:
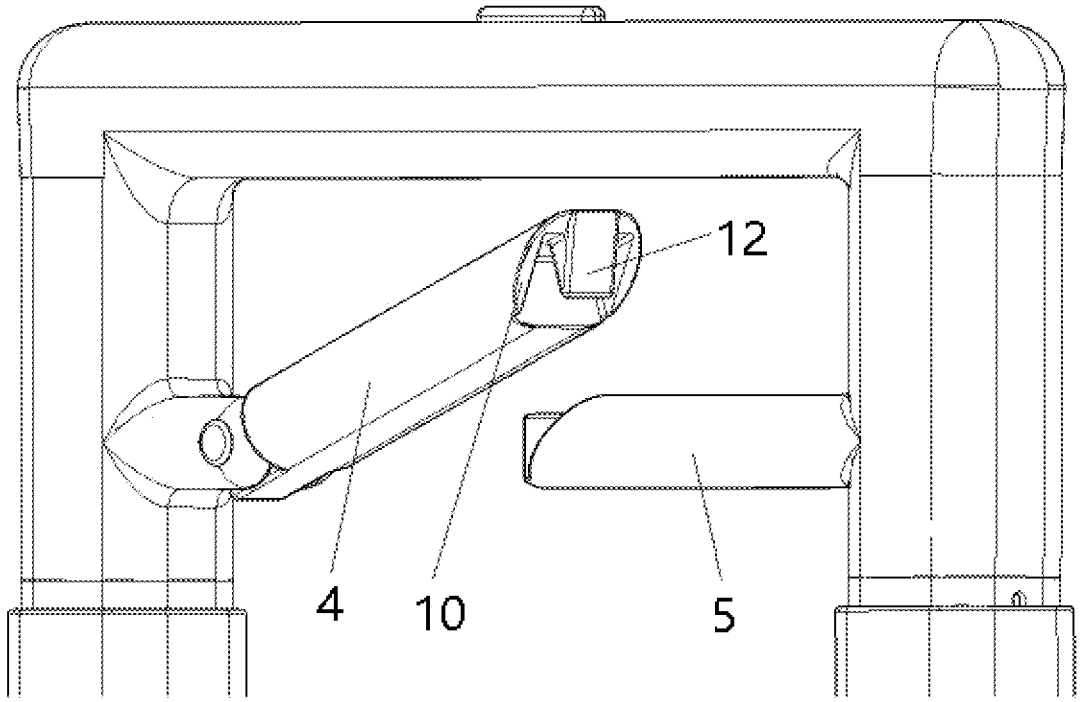
FIG. 6 illustrates a schematic structural view of a first rod body.
Figure 7:
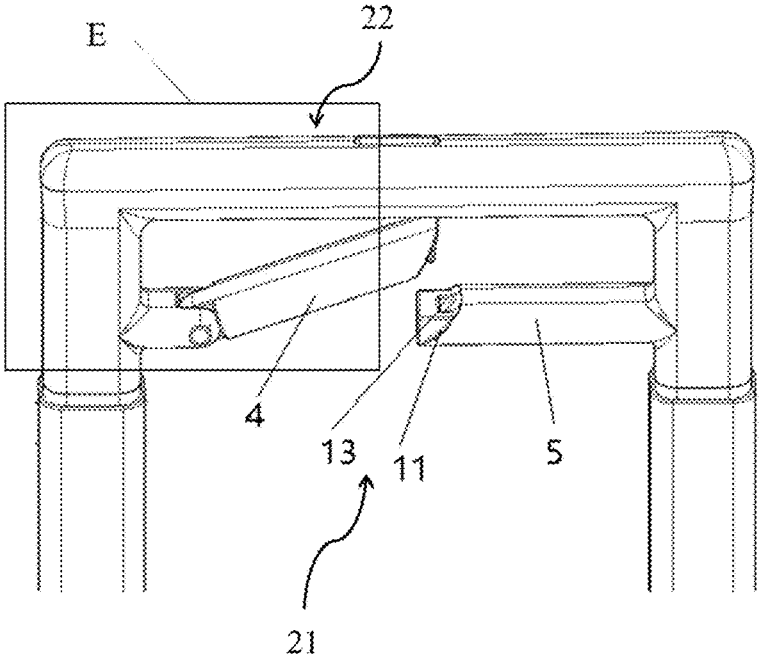
FIG. 7 illustrates a schematic structural view of a second rod body.
Figure 8:
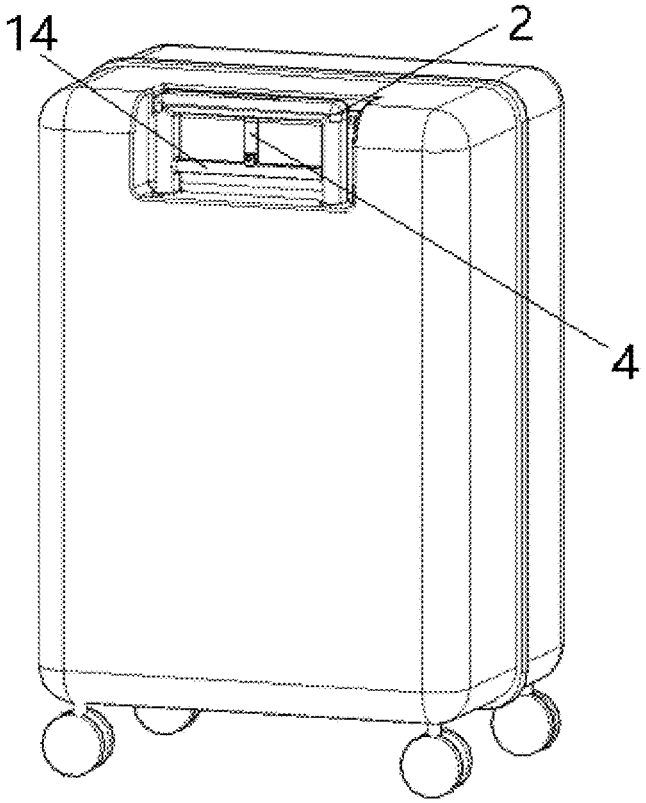
FIG. 8 illustrates a schematic structural view of further another movable hanging rod in a state of its first rod body being not opened to define a gap.
Figure 9:
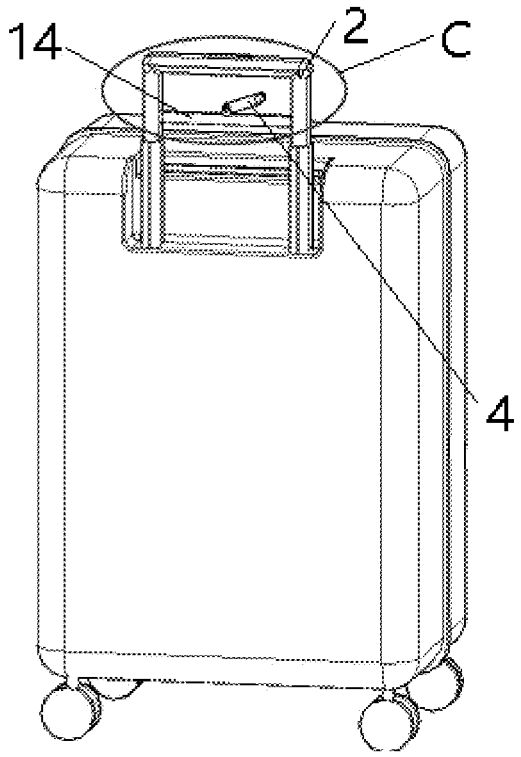
FIG. 9 illustrates a schematic structural view of the further another movable hanging rod in another state of its first rod body being opened to define the gap.
Figure 10:
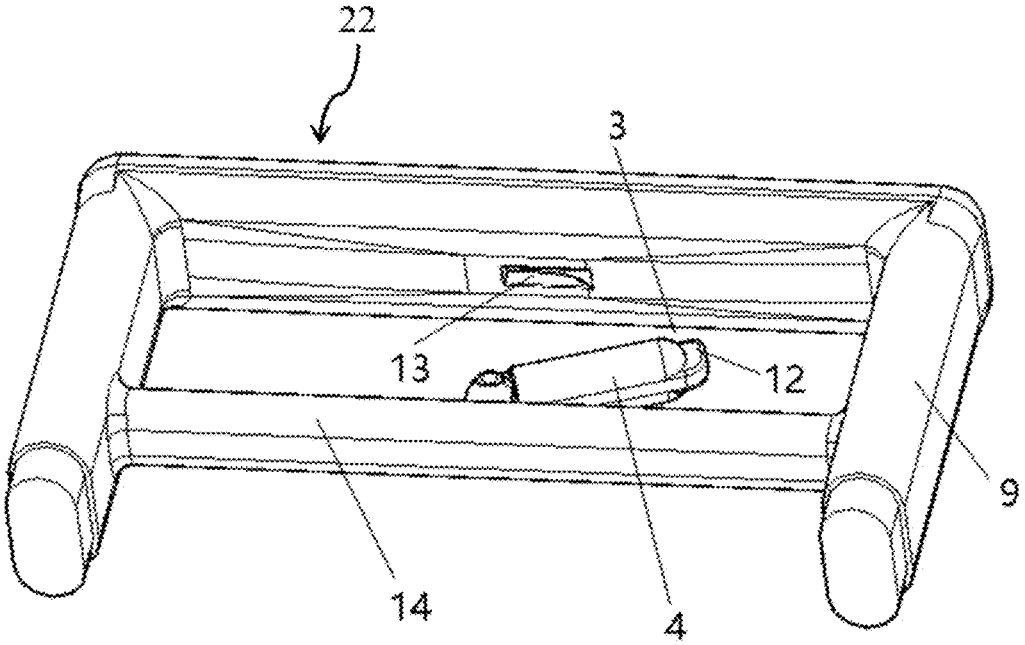
FIG. 10 illustrates a schematic partial enlarged view of the portion C in FIG. 9.
Figure 11:
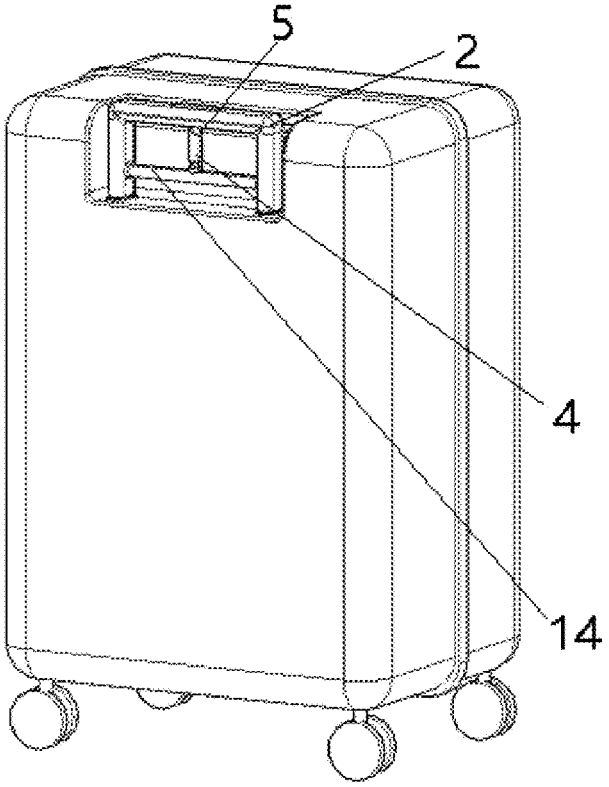
FIG. 11 illustrates a schematic structural view of even another movable hanging rod in a state of its first rod body being not opened to define a gap.
Figure 12:
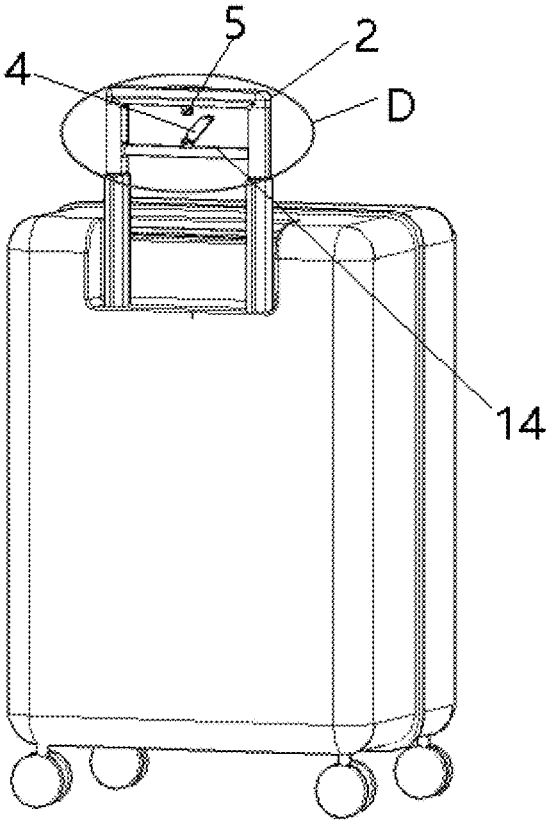
FIG. 12 illustrates a schematic structural view of the even another movable hanging rod in another state of its first rod body being opened to define the gap.
Figure 13:
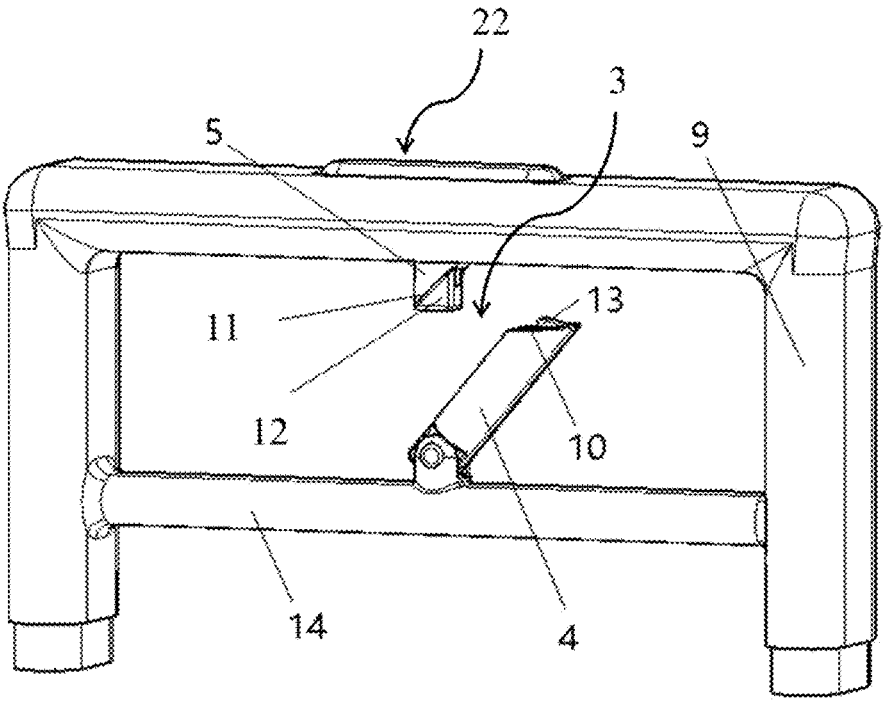
FIG. 13 illustrates a schematic partial enlarged view of the portion D in FIG. 12.
Figure 14:
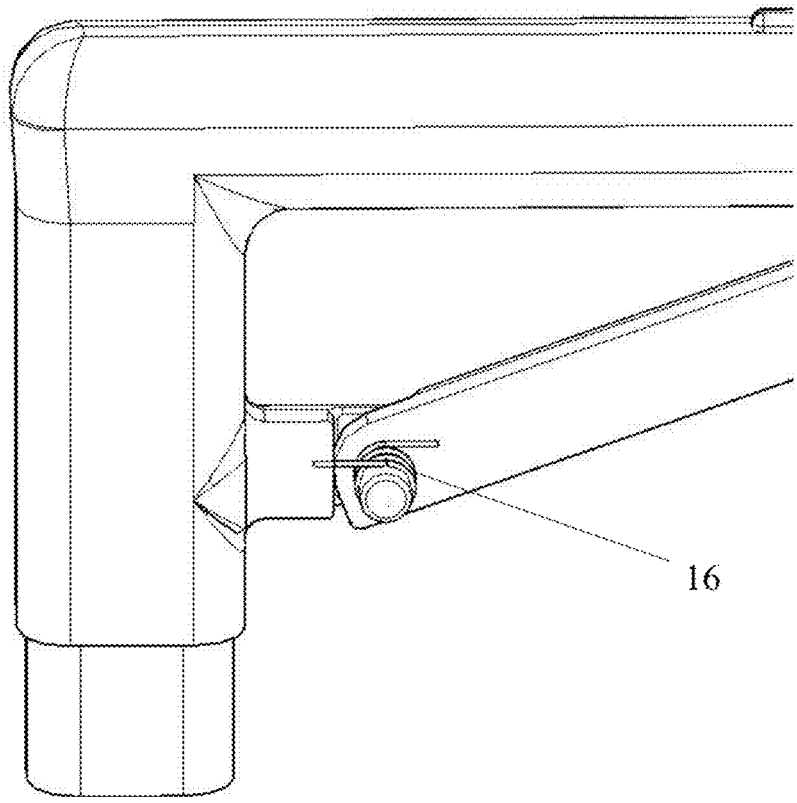
FIG. 14 illustrates an internal schematic structural view of the movable hanging rod, and the position of the internal schematic structural view is the same as the portion E in FIG. 7.
Figure 15:
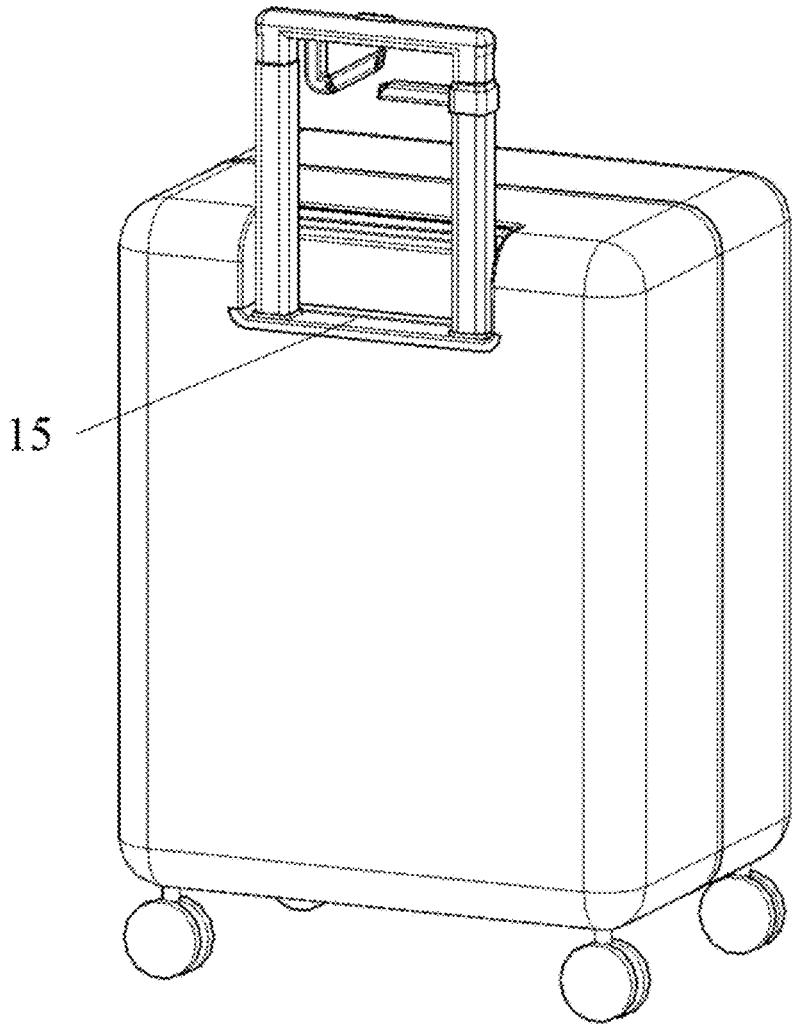
FIG. 15 illustrates a schematic structural view of a handle base.
Figure 16:
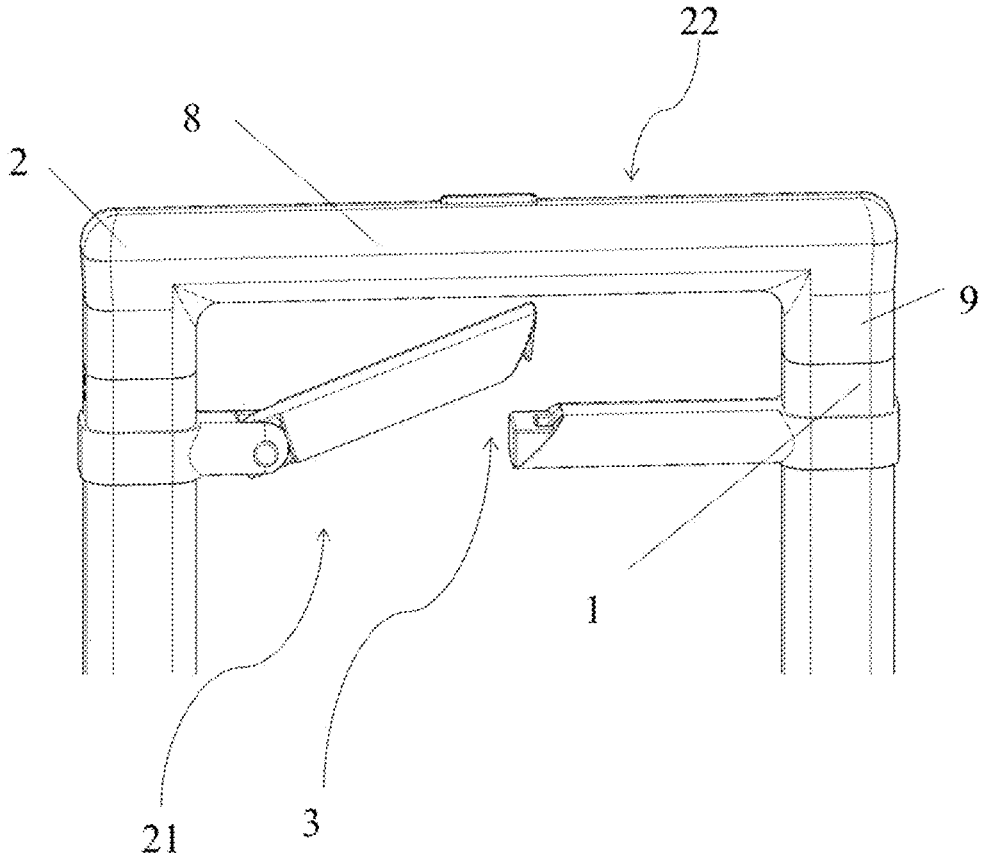
FIG. 16 illustrates a schematic structural view of the movable hanging rod disposing on telescopic rods, and the movable hanging rod, the telescopic rod and a handlebar together forming a closed frame structure.
Figure 17:
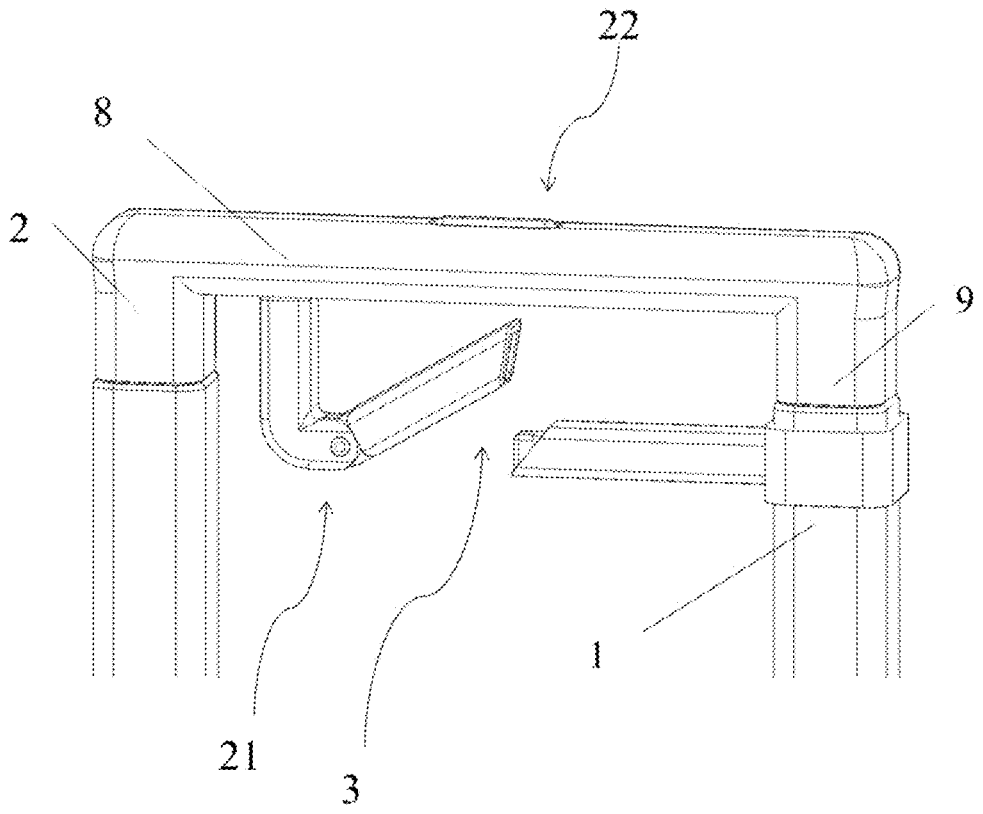
FIG. 17 illustrates a schematic structural view of another movable hanging rod disposing on the handlebar and the telescopic rod, and the movable hanging rod, the telescopic rod and the handlebar together forming a closed frame structure.

Specific structures are shown in FIG. 1 through FIG. 17.

An embodiment of the disclosure provides a suitcase telescopic handle, which includes a telescopic rod 1, a handlebar 2 and a movable hanging rod 21. The telescopic rod 1 is two in number being respectively connected to two ends of the handlebar 2. The telescopic rod 1 is configured to be installed on a main body 110 of a suitcase 100 (also referred to as installed on a suitcase body). In an example, the movable hanging rod 21 is disposed on the handlebar 2, the movable hanging rod 21 and the handlebar 2 are operative to form a closed frame structure 22 for hanging items. In another example, the movable hanging rod 21 is disposed on the telescopic rod 1, and the movable hanging rod 21, the telescopic rod 1 and the handlebar 2 are operative to form a frame structure for hanging the items. In still another example, the movable hanging rod 21 is disposed on the handlebar 2 and the telescopic rod 1, and the movable hanging rod 21, the telescopic rod 1 and the handlebar 2 are operative to form a closed frame structure 22 for hanging the items. Moreover, the movable hanging rod 21 is rotatable to define a gap 3 to open the closed frame structure 22.

In some embodiments, when in use, the closed frame structure 22 can be opened to define the gap 3 by conducting a rotation operation on the movable hanging rod 21, allowing a user to conveniently hang multiple items such as small handbags, an umbrella, bags containing snacks and water bottles on the movable hanging rod 21 at any time. Therefore, hands of the user can be freed up for other travel-related tasks like answering calls, passing ticket checks or shopping to avoid being flustered and disorganized and thus effortless and hassle-free for the user. In addition, when undergoing a security check, the suitcase telescopic handle can be retracted, allowing the suitcase 100 and all the attached/hung items to be placed on a security conveyor belt together, which can prevent these items from scattering and getting lost, and can also avoid congestion caused by excessively long waits for passengers further back in the security queue. The movable hanging rod 21 is disposed on the handlebar 2 and/or the telescopic rod 1, it does not occupy a storage space of the main body 110 of the suitcase 100 and also does not increase a volume of the main body 110 of the suitcase 100, and moreover does not affect an appearance of the main body 110, and storing, a boarding or a checking-in of the suitcase 100. When the suitcase telescopic handle is extended, the movable hanging rod 21 rises up correspondingly and its height can be closer to an upper body of the user, enabling the user to easily access the items without bending down while pushing the suitcase 100 or standing in line, offering a highly user-friendly experience.

In some embodiments, the movable hanging rod 21 is a single rod, the movable hanging rod 21 is rotatably mounted below a gripping part 8 of the handlebar 2. Specifically, one end of the movable hanging rod 21 is rotatably connected to one connecting part 9 of the handlebar 2, and the other end of the movable hanging rod 21 is arranged onto another connecting part 9 of the handlebar 2 or arranged onto one telescopic rod 1; by rotating the movable hanging rod 21 upwards, the gap 3 is defined between the other end of the movable hanging rod 21 and the another connecting part 9 of the handlebar 2 or the telescopic rod 1, to open the closed frame structure 22 consequently, so that an item like a handbag can be hung on the movable hanging rod 21 through the gap 3. After the item is hung on the movable hanging rod 21, by rotating the movable hanging rod 21 downwards to go back its original position, the closed frame structure 22 is closed correspondingly. It can be found that the movable hanging rod 21 is simple in structure and is convenient to use. In an alternative example, one end of the movable hanging rod 21 is rotatably connected to one telescopic rod 1, and the other end of the movable hanging rod 21 is arranged onto the other one telescopic rod 1 or arranged onto the connecting part 9 of the handlebar 2 corresponding to the other one telescopic rod 1, effects same as the above-mentioned effects can be achieved, and thus will not be repeated herein.

In some embodiments, the movable hanging rod 21 includes a first rod body 4 and a second rod body 5. A first end of the first rod body 4 is connected to the handlebar 2 or one telescopic rod 1, a first end of the second rod body 5 is connected to the handlebar 2 or one telescopic rod 1. A second end of the first rod body 4 corresponds to a second end of the second rod body 5, the first rod body 4 is rotatable to define the gap 3 between the first rod body 4 and the second rod body 5. The closed frame structure 22 can be opened through cooperation of the first rod body 4 and the second rod body 5, the structure is simple and stable.

Specifically, both the first rod body 4 and the second rod body 5 are straight in shape. It can be that the first end of the first rod body 4 is rotatably connected to one connecting part 9 of the handlebar 2, the first end of the second rod body 5 is fixedly connected to another connecting part 9 of the handlebar 2 or one telescopic rod 1, the second end of the first rod body 4 is arranged corresponding to the second end of the second rod body 5. By rotating the first rod body 4 upwards, the gap 3 is correspondingly defined/formed between the second end of the first rod body 4 and the second end of the second rod body 5, to open the closed frame structure 22 consequently, allowing an item like a handbag to be hung on the first rod body 4 and/or the second rod body 5. After the item is hung, by rotating the first rod body 4 downwards to go back the original position of the first rod body 4, the closed frame structure 22 is closed correspondingly. It can be found that it is simple in structure and easy to use. Alternatively, the first end of the first rod body 4 is rotatably connected to one telescopic rod 1, the first end of the second rod body 5 is fixedly connected to the other one telescopic rod 1 or the connecting part 9 of the handlebar 2 corresponding to the other one telescopic rod 1, effects same as the above-mentioned effects can be achieved and thus will not be repeated herein.

In some embodiments, the first rod body 4 is bent in shape, and includes a first section 6 and a second section 7. The first section 6 is connected to a gripping part 8 of the handlebar 2, the second section 7 is rotatable relative to the first section 6. Moreover, in an example, the second rod body 5 is bent in shape, and one end of the second rod body 5 is connected to the gripping part 8 of the handlebar 2. In an alternative example, the second rod body 5 is straight in shape, and one end of the second rod body 5 is connected to one connecting part 9 of the handlebar 2 or one telescopic rod 1. In addition, the other end of the second rod body 5 corresponds to the second section 7.

In some embodiments, the first rod body 4 is bent in shape, and the first rod body 4 is divided into the first section 6 and the second section 7. One end of the second section 7 is rotatably connected to one end of the first section 6, and another end of the first section 6 is fixedly connected to the gripping section 8 of the handlebar 2. In this case, the second rod body 5 may have two implementations. Specifically, one of the implementations is that the second rod body 5 is also bent in shape, one end of the second rod body 5 is fixedly connected to the gripping section 8 of the handlebar 2, and another end of the second rod body 5 is arranged corresponding to the other end of the second section 7, so that by rotating the second section 7 upwards, a gap 3 is defined/formed between the other end of the second section 7 and the another end of the second rod body 5, to open the closed frame structure 22 consequently. The other one of the implementations is that the second rod body 5 is straight in shape, one end of the second rod body 5 is fixedly connected to the connecting part 9 of the handlebar 2 or the telescopic rod 1, and the other end of the second rod body 5 is arranged corresponding to the other end of the second section 7, effects same as the above-mentioned effects can be achieved and thus will not be repeated herein.

In some embodiments, the movable hanging rod 21 has still another implementation. Specifically, the movable hanging rod 21 includes the first rod body 4 and a third rod body 14. An end of the third rod body 14 is connected to one connecting part 9 of the handlebar 2 or one telescopic rod 1, another end of the third rod body 14 is connected to the other one connecting part 9 of the handlebar 2 or the other one telescopic rod 1. The first rod body 4 is disposed between the gripping part 8 of the handlebar 2 and the third rod body 14, an end of the first rod body 4 is rotatably connected to the third rod body 14, and the first rod body 4 is operative to define the gap 3 between the first rod body 4 and the gripping part 8 of the handlebar 2 by rotation. It can be found that it is simple in structure, and easy to use for the user. It should be noted that in this implementation, a limiting protrusion 12 and a limiting groove 13 may be respectively disposed on the gripping part 8 of the handlebar 2 and the first rod body 4, the limiting protrusion 12 and the limiting groove 13 can be engaged with each other to limit a rotation direction of the first rod body 4, enabling the first rod body 4 to unidirectionally rotate.

Furthermore, the movable hanging rod 21 may further include the second rod body 5. The second rod body 5 is disposed between the gripping part 8 of the handlebar 2 and the third rod body 14. An end of the second rod body 5 is connected to the gripping part 8 of the handlebar 2, and another end of the second rod body 5 is arranged corresponding to the first rod body 4. The first rod body 4 is rotatable to define a gap 3 between the first rod body 4 and the second rod body 5. Effects same as the above-mentioned effects can be achieved and thus will not be repeated herein.

In some embodiments, a limiting structure is provided between the first rod body 4 and the second rod body 5. The limiting structure is configured to limit the rotation direction of the first rod body 4, thereby allowing the first rod body 4 to unidirectionally rotate.

In some embodiments, the presence of the limiting structure ensures that the first rod body 4 is unidirectionally rotatable to open the closed frame structure 22, thereby guaranteeing use reliability.

In some embodiments, the limiting structure includes a first inclined surface 10 on the first rod body 10 and a second inclined surface 11 on the second rod body 5, and the first inclined surface 10 and the second inclined surface 11 are arranged corresponding to each other and have a same inclination direction. By using the first inclined surface 10 and the second inclined surface 11 to realize positionally limiting, it is simple in structure, easy to produce and can achieve stable positionally limiting.

In some embodiments, the limiting structure includes a limiting protrusion 12 and a limiting groove 13 matched with each other. The limiting protrusion 12 is disposed on one of the first rod body 4 and the second rod body 5, and the limiting groove 13 is disposed on the other one of the first rod body 4 and the second rod body 5. By using the limiting protrusion 12 and the limiting groove 13 to realize positionally limiting, it is simple in structure, easy to produce and can achieve stable positionally limiting.

In some embodiments, the limiting protrusion 12 is disposed on the first inclined surface and the limiting groove 13 is disposed on the second inclined surface 11, which can further enhance the stability of positionally limiting.

It should be noted that, the gripping part 8 of the handlebar 2 is configured to be held by the human hand, and the connecting parts 9 of the handlebar 2 are configured to connect to the respective telescopic rods 1.

In some embodiments, the suitcase telescopic handle may further include a torsion spring 16. The torsion spring 16 is disposed at a rotating part of the movable hanging rod 21. After the movable hanging rod 21 is rotated to define the gap 3 and an item like a handbag is hung on the movable hanging rod 21, by use of the torsion spring 16, the movable hanging rod 21 can automatically restore its original position to close the closed frame structure 22, and thus it is convenient to use and can achieve stable closing effect.

In some embodiments, a handle base 15 may be further provided on the main body 110 of the suitcase 100. The telescopic rods 1 are disposed on the handle base, and the movable hanging rod 21 is spaced from the handle base. When the telescopic rods 1 are retracted, an item like a bag can still be hung on the movable hanging rod 21 without affecting the retraction of the telescopic rods 1.

It should be noted that, in a situation that no handle base 15 is provided, when the telescopic rods 1 are retracted, the movable hanging rod 21 is still required to be spaced from the main body 110 of the suitcase 100, ensuring that an item like a bag can be hung on the movable hanging rod 21 without hindering the retraction of the telescopic rod 1.

It should also be noted that, the connecting part 9 of the handlebar 2 can be bar-shaped, arc-shaped, or any other bent shape, as long as it can meet requirements.

In addition, a suitcase 100 according to an embodiment of the disclosure may include the suitcase telescopic handle of any one of above-mentioned embodiments. Therefore, the suitcase 100 achieves the same technical advantages and effects as that of the suitcase telescopic handle, which will not be repeated herein. Moreover, in some embodiments, the suitcase 100 may further include a main body 110 (also referred to as suitcase body), and the telescopic rods 1 of the suitcase telescopic handle are installed on the main body 110.

In some embodiments, the telescopic rods 1 can be mounted on any one side or two sides of the main body 110 of the suitcase 100, to enhance applicability.

Finally, it should be noted that the above embodiments are merely to exemplarily describe technical solutions of the disclosure and are not used to limit the disclosure. Although the disclosure has been described in detail by referring to the aforementioned embodiments, those skilled in the art should understand that they may still modify the technical solutions of the above-mentioned embodiments or equivalently substitute some or all of technical features of the above-mentioned embodiments to form corresponding technical solutions. Such modifications or substitutions shall not make the essence of the corresponding technical solutions depart from the scope of the technical solutions of the above-mentioned embodiments of the disclosure.

What is claimed is:

1. A suitcase telescopic handle, comprising a telescopic rod (1), a handlebar (2), and a movable hanging rod (21);

wherein the telescopic rod (1) is two in number being respectively connected to two ends of the handlebar (2), and the telescopic rod (1) is configured to be installed on a main body (110) of a suitcase (100);

wherein the movable hanging rod (21) comprises a first rod body (4), a second rod body (5), and a third rod body (14);

wherein an end of the third rod body (14) is connected to a connecting part (9) of the handlebar (2) or one the telescopic rod (1), another end of the third rod body (14) is connected to another connecting part (9) of the handlebar (2) or another the telescopic rod (1);

wherein the first rod body (4) is disposed between a gripping part (8) of the handlebar (2) and the third rod body (14), and an end of the first rod body (4) is in hinged connection with the third rod body (14) to allow the first rod body (4) to rotate relative to the third rod body (14), and the first rod body (4) is operative to define a gap (3) between the gripping part (8) of the handlebar (2) and the first rod body (4) by rotation; and wherein the second rod body (5) is disposed between the gripping part (8) of the handlebar (2) and the third rod body (14), and an end of the second rod body (5) is connected to the gripping part (8) of the handlebar (2), another end of the second rod body (5) corresponds to the first rod body (4), the first rod body (4) is operative to define the gap (3) between the second rod body (5) and the first rod body (4) by rotation.

2. The suitcase telescopic handle as claimed in claim 1, wherein a limiting structure is provided between the first rod body (4) and the second rod body (5), and the limiting structure is configured to limit rotation of the first rod body (4).

3. The suitcase telescopic handle as claimed in claim 2, wherein the limiting structure comprises a limiting protrusion (12) and a limiting groove (13) matched with each other, the limiting protrusion (12) is disposed on the second rod body (5), and the limiting groove (13) is disposed on the first rod body (4).

4. The suitcase telescopic handle as claimed in claim 1, wherein the suitcase telescopic handle further comprises a torsion spring (16), and the torsion spring (16) is disposed at a rotation part of the movable hanging rod (21).

5. The suitcase telescopic handle as claimed in claim 1, wherein the suitcase telescopic handle further comprises a handle base (15) configured to be disposed on the main body (110) of the suitcase (100), the telescopic rod (1) is disposed on the handle base (15), and the movable hanging rod (21) is spaced from the handle base (15).

6. A suitcase (100) comprising the suitcase telescopic handle as claimed in claim 1.

* * * * *